US008939252B2

(12) United States Patent
Sanborn

(10) Patent No.: US 8,939,252 B2
(45) Date of Patent: Jan. 27, 2015

(54) PROTECTIVE MATERIAL FOR ACOUSTIC TRANSMISSION

(71) Applicant: David Sanborn, Atlanta, GA (US)

(72) Inventor: David Sanborn, Atlanta, GA (US)

( * ) Notice: Subject to any disclaimer, the term of this patent is extended or adjusted under 35 U.S.C. 154(b) by 0 days.

(21) Appl. No.: 14/056,835

(22) Filed: Oct. 17, 2013

(65) Prior Publication Data

US 2014/0131133 A1 May 15, 2014

Related U.S. Application Data

(60) Provisional application No. 61/725,013, filed on Nov. 11, 2012.

(51) Int. Cl.
*H04R 1/02* (2006.01)

(52) U.S. Cl.
USPC ..... 181/199

(58) Field of Classification Search
CPC ..... H04R 1/02
USPC ..... 181/199
See application file for complete search history.

(56) References Cited

U.S. PATENT DOCUMENTS

| | | | | |
|---|---|---|---|---|
| 3,953,566 | A | | 4/1976 | Gore |
| 4,071,040 | A | | 1/1978 | Moriarty |
| 4,110,392 | A | | 8/1978 | Yamazaki |
| 4,187,390 | A | | 2/1980 | Gore |
| 4,949,386 | A | | 8/1990 | Hill |
| 4,987,597 | A | | 1/1991 | Haertl |
| 5,116,650 | A | | 5/1992 | Bowser |
| 5,286,279 | A | | 2/1994 | Wu |
| 5,342,434 | A | | 8/1994 | Wu |
| 5,376,441 | A | | 12/1994 | Wu et al. |
| 5,385,694 | A | | 1/1995 | Wu et al. |
| 5,420,570 | A | | 5/1995 | Leitten et al. |
| 5,460,872 | A | | 10/1995 | Wu et al. |
| 5,461,326 | A | * | 10/1995 | Woith et al. ..... 324/750.25 |
| 5,462,586 | A | | 10/1995 | Sugiyama et al. |
| 5,828,012 | A | | 10/1998 | Repolle et al. |
| 5,838,309 | A | * | 11/1998 | Robsky et al. ..... 345/173 |
| 5,899,027 | A | * | 5/1999 | St. Louis ..... 52/63 |
| 6,512,834 | B1 | | 1/2003 | Banter et al. |
| 7,687,736 | B2 | * | 3/2010 | Auger et al. ..... 200/600 |
| 8,067,710 | B2 | * | 11/2011 | Auger et al. ..... 200/600 |
| 8,225,492 | B2 | * | 7/2012 | Auger et al. ..... 29/622 |
| 2005/0241929 | A1 | * | 11/2005 | Auger et al. ..... 200/512 |

(Continued)

FOREIGN PATENT DOCUMENTS

| | | |
|---|---|---|
| GB | 2064265 | 6/1981 |
| JP | 10-165787 | 6/1998 |
| WO | 2001003468 | 1/2001 |

*Primary Examiner* — Forrest M Phillips
(74) *Attorney, Agent, or Firm* — Withers & Keys, LLC

(57) ABSTRACT

A protective material for acoustic transmission is disclosed which optimizes sound transmission of the material while also providing a barrier from ambient conditions to transducers. The protective material of the disclosure is a self-tensioning membrane with properties such that sound attenuation is minimized as the membrane transfers acoustic energy. In one embodiment, the self-tensioning membrane is used to cover an opening in an electronic device enclosure by securing the entire outer edge of the membrane with an adhesive. Such a construction creates an unbound region where the self-tensioning membrane can effectively transmit sound energy by moving in response to incoming sound waves. The self-tensioning membrane allows sound to travel out of the protective enclosure while also preventing liquid or particulate intrusion.

20 Claims, 12 Drawing Sheets

(56) References Cited

U.S. PATENT DOCUMENTS

| | | | | |
|---|---|---|---|---|
| 2006/0093883 | A1* | 5/2006 | Pristash | 429/30 |
| 2008/0083602 | A1* | 4/2008 | Auger et al. | 200/400 |
| 2010/0162554 | A1* | 7/2010 | Auger et al. | 29/592.1 |
| 2011/0143114 | A1 | 6/2011 | Horie et al. | |
| 2014/0083296 | A1 | 3/2014 | Sanders | |
| 2014/0093095 | A1 | 4/2014 | Slotte | |

* cited by examiner

PROTECTIVE MATERIAL FOR ACOUSTIC TRANSMISSION

CROSS-REFERENCE TO RELATED APPLICATIONS

This patent application claims the benefit of priority to U.S. Provisional Patent Application Ser. No. 61/725,013 filed on Nov. 11, 2012 and entitled "PROTECTIVE MATERIAL FOR ACOUSTIC TRANSMISSION", the subject matter of which is hereby incorporated by reference in its entirety.

FIELD OF THE INVENTION

The present invention is directed to protective materials suitable for use in acoustic transmission applications. The present invention is further directed to casings and/or protective enclosures suitable for housing a sound-producing device (e.g., a speaker).

BACKGROUND

Protective materials for acoustic transmission described in prior art typically focus on membrane porosity as a means of sound transmission and are designed for portable electronics where they provide a barrier from liquid intrusion to sufficiently small acoustic transducers and acoustic vent openings (e.g., less than 5 $cm^2$), as commonly found in cellphones and other portable electronic devices with transducers. Other electronics, such as portable speaker systems, require a similar level of protection as demanded for cellphones, but acoustic vent openings in portable speaker enclosures are required to be significantly larger than that of a cellphone or small portable electronic device. Furthermore, some modern portable speaker systems can emit sound with frequency in the range of 20 Hz-20 kHz. The prior art does not adequately teach the materials or construction required to optimize sound transmission and protection for large acoustic vent openings nor does it effectively address the need for optimizing acoustic transmission across a broad range of audible frequencies.

There is a need in the art to provide improved protective materials for acoustic transmission, wherein the protective materials provide exceptional acoustic transmission across a broad range of audible frequencies, for example, in the range of 20 Hz to 20 kHz.

SUMMARY

The present invention addresses some of the difficulties and problems discussed above by the discovery of a protective material for acoustic transmission.

A protective material for acoustic transmission is disclosed that serves as a barrier from liquid and particulate intrusion to sound emitting devices while providing better sound transmission properties than prior art sound-transmissive protective materials. The disclosed protective material is a polymeric membrane that exhibits excellent sound transmission and resistance to long-term liquid entry due to the ability of the membrane to create and maintain tension as well as other physical properties including mass and thickness. The focus on membrane self-tensioning properties allows for the construction of a sound transmissive cover that effectively reduces sound transmission loss and sound contamination observed in sound transmissive covers and membranes defined in prior art.

According to one embodiment of the disclosure, the self-tensioning membrane is bonded to a frame (e.g., a rigid frame as shown in FIGS. 1-3 and 6A-6B, or a flexible frame as shown in FIGS. 9A-9B) using an adhesive. Depending on the composition of the self-tensioning membrane, heat may be applied to the membrane to bring the film to a tensioned state after attachment to the frame. Such a construction creates an outer bonded region and a tensioned inner region where the film can react to sound pressure waves and transmit that sound energy to the medium on the opposite side of the film. A double sided adhesive may be applied to the outer edge of the film, opposite the frame, such that the film is between the frame and the second adhesive layer. The additional adhesive acts as a bonding system and gasket when the frame is installed over an acoustic vent opening in a protective enclosure. Such a frame construction allows the self-tensioning membrane to exert the majority of tension force on the frame and not on the second adhesive layer bonded to the surface of a protective enclosure. Furthermore, the frame assembly allows the self-tensioning membrane to be easily handled during installation.

According to another embodiment of the disclosure, the outer edge of the self-tensioning membrane is bonded to a double-sided adhesive in such that an inner, unbound, region is formed. The assembly can then be installed over an acoustic vent opening in a protective enclosure. In this embodiment, the double sided adhesive is strong enough to resist the tension forces exerted upon the adhesive.

These and other features and advantages of the present invention will become apparent after a review of the following detailed description of the disclosed embodiments and the appended claims.

DETAILED DESCRIPTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

As seen in attached drawings and outlined herein, two embodiments of the protective material for acoustic transmission are generally shown in dimensions and configurations such that they are designed to be used as a sound-transmissive barrier in a loudspeaker enclosure. The protective material for acoustic transmission of the present disclosure is not limited to the embodiments illustrated as these depictions can be modified or adjusted without deviating from the scope of the invention.

As the terms are used herein, "protective material for acoustic transmission" may be interchanged with "self-tensioning membrane" which means a continuous sheet of material that will actively pursue a condensed state either by internal elastic force or by molecular realignment caused by external stimuli.

As the term is used herein, "rigid frame" means a sufficiently rigid structure that is formed from either a single part or parts and provides a support structure and adhesive location for the outer edge of the self-tensioning membrane while having a hollow central region where the membrane can move freely. The required stiffness of the rigid frame can be variable dependent on the amount of force exerted by the self-tensioning membrane.

As the term is used herein, "flexible frame" means a structure that is formed from either a single part or parts and provides a support structure for the self-tensioning membrane while having a hollow central region where at least portions of the membrane can move freely.

Figure 1:
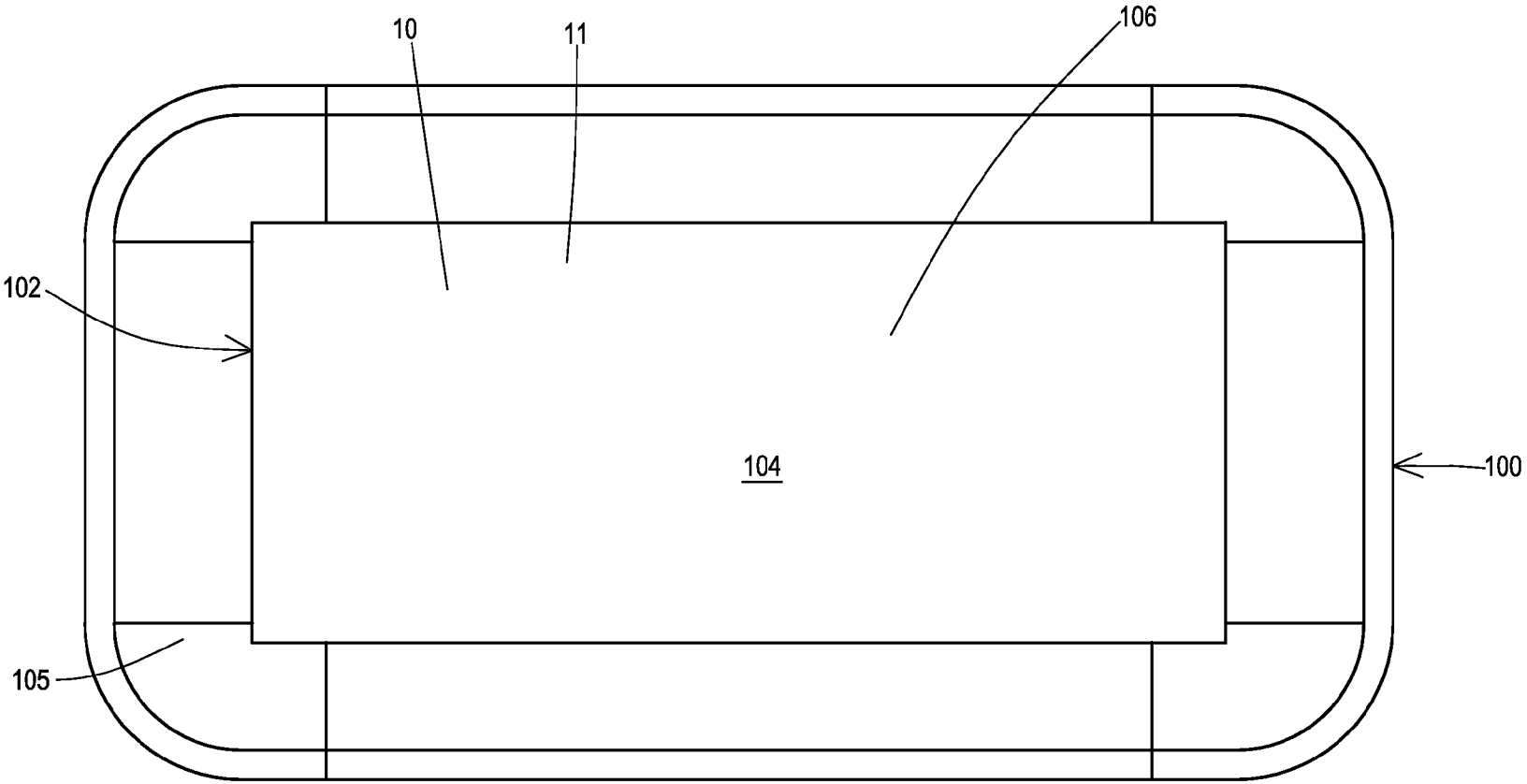
FIG. 1 is an external view of an exemplary protective enclosure employing an exemplary sound transmissive cover.

FIG. 1 is an external view of a rigid, protective enclosure 100, designed to house a portable loudspeaker device (not shown), with an acoustic vent opening 102 in the lid 105 of the enclosure 100. FIG. 1 also illustrates the general installation location for a self-tensioning membrane 104. The size, shape and location of the acoustic vent opening 102 could vary depending on the size of the protective enclosure 100 and the device enclosed.

An example of a protective enclosure 100 could be an injection molded waterproof case system where a portable loudspeaker device could be temporarily installed. Such a case system would be inherently waterproof, but the rigid protective structure would prohibit adequate sound transmission from within the case. Enabling sound transmission from within the case requires a sufficiently sized acoustic vent opening 102 to be cut into the lid 105 of the case 100. A sound transmissive cover, as described in embodiments of the disclosure, could then be installed over the acoustic vent opening 102 to provide a barrier against liquid and particulate intrusion while transmitting sound from the interior to the exterior of the case 100.

Figure 2:
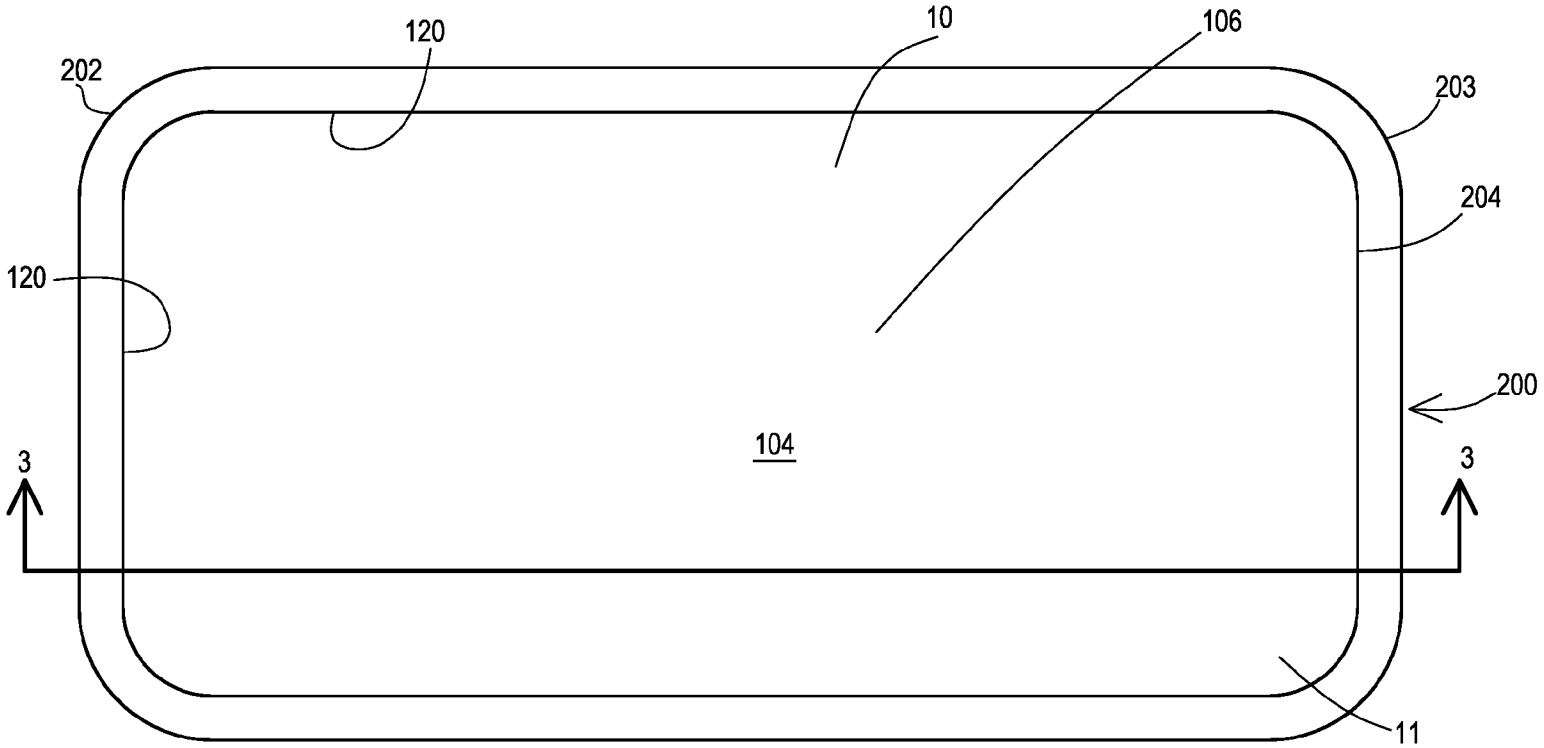
FIG. 2 is a top view of an exemplary sound transmissive cover as detailed in an embodiment of the present invention.
Figure 3:
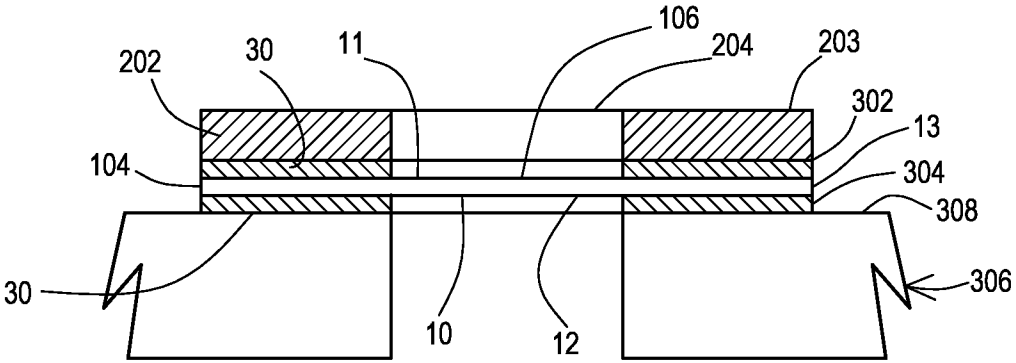
FIG. 3 is a cross-sectional view of the exemplary sound transmissive cover shown in FIG. 2, taken along line 3-3, where the exemplary sound transmissive cover is attached to the surface of a protective enclosure.

FIGS. 2 and 3 illustrate one embodiment of the disclosure where a sound transmissive cover 200 is constructed with a self-tensioning membrane 104 and a rigid frame 202, where the membrane 104 and the frame 202 are bonded with an adhesive 302. Such a construction creates an inner unbound region 106 where the self-tensioning membrane 104 can move in response to incoming sound waves. A double sided adhesive 304 applied to the outer edge 120 of the film 104, opposite the rigid frame 202, creates a construction such that the self-tensioning film 104 is now between the rigid frame 202 and the second adhesive layer 304. The sound transmissive cover 200 can then be attached to the surface 308 of a protective enclosure 306, where the double-sided adhesive 304 serves to create a gasket and bond between the self-tensioning membrane 104 and the surface 308 of a protective enclosure 306.

The self-tensioning membrane 104 serves as a barrier to liquid and particulate entry while also transmitting sound from one side of the membrane 104 to the other. To provide sustained acoustic performance across varying environmental conditions and over the life of the sound transmissive cover 200, the self-tensioning membrane 104 must have the ability to maintain or, at a minimum, regain tension.

The ability of the membrane 104 to maintain or regain tension is inherent only to certain classes of materials and, therefore, not all materials would be able to achieve the same self-tensioning effect. The self-tensioning membrane 104 as described in this disclosure could be composed of, but is not limited to, elastomeric materials such as thermoplastic polyurethane "TPU" or a group of polymer films that seek a condensed state due to molecular realignment. One group of molecularly oriented films, which seeks a condensed state due to molecular realignment, is commonly known as "shrink film." Shrink films can be composed of, but are not limited to, polyolefins such as polyethylene or polypropylene, and polyvinyl chloride "PVC".

Whether the self-tensioning membrane 104 is composed of an elastomeric material or a film with shrink capabilities, the membrane 104 should desirably have the following properties: a film thickness in a range of about 5 to about 100 microns, preferably from about 5 to about 20 microns; and a mass in the range of about 1 to about 35 g/m$^2$, preferably from about 1 to about 20 g/m$^2$. Should the self-tensioning membrane 104 be composed of an elastomer, the material should desirably be able to stretch to an area greater than 5% of an original size. Should the self-tensioning membrane be a "shrink" film, the free shrinkage should desirably be greater than 5% of the original surface area, preferably greater than about 20% of the original surface area.

The rigid frame 202 of the present embodiment may, for example, be constructed from 0.019" thick aluminum, where a flat aluminum sheet is die-cut to produce the frame shape. The self-tensioning membrane 104 may be adhered to the rigid frame 202 using a high-performance spray adhesive 302 although many other types of bonding materials could be chosen to provide a sufficiently strong bond. The self-tensioning membrane 104 of this embodiment may be a "shrink" film and thus be heated after bonding to the rigid frame 202 in order to achieve a tensioned inner region 106 where the film 104 can move in response to sound energy. The purpose of the rigid frame structure 202 is to support the tension forces exerted by the membrane 104.

The double-sided adhesive 304 of the present embodiment may be a commercially-available, acrylic tape, although other types of bonding materials could serve the same function. The task function of the double-sided adhesive 304 is to create a durable bond and gasket between the self-tensioning membrane 104 and the surface 308 of a protective enclosure 306.

Such a bond would be required to resist external forces acting on the sound transmissive cover 200.

Figure 4:
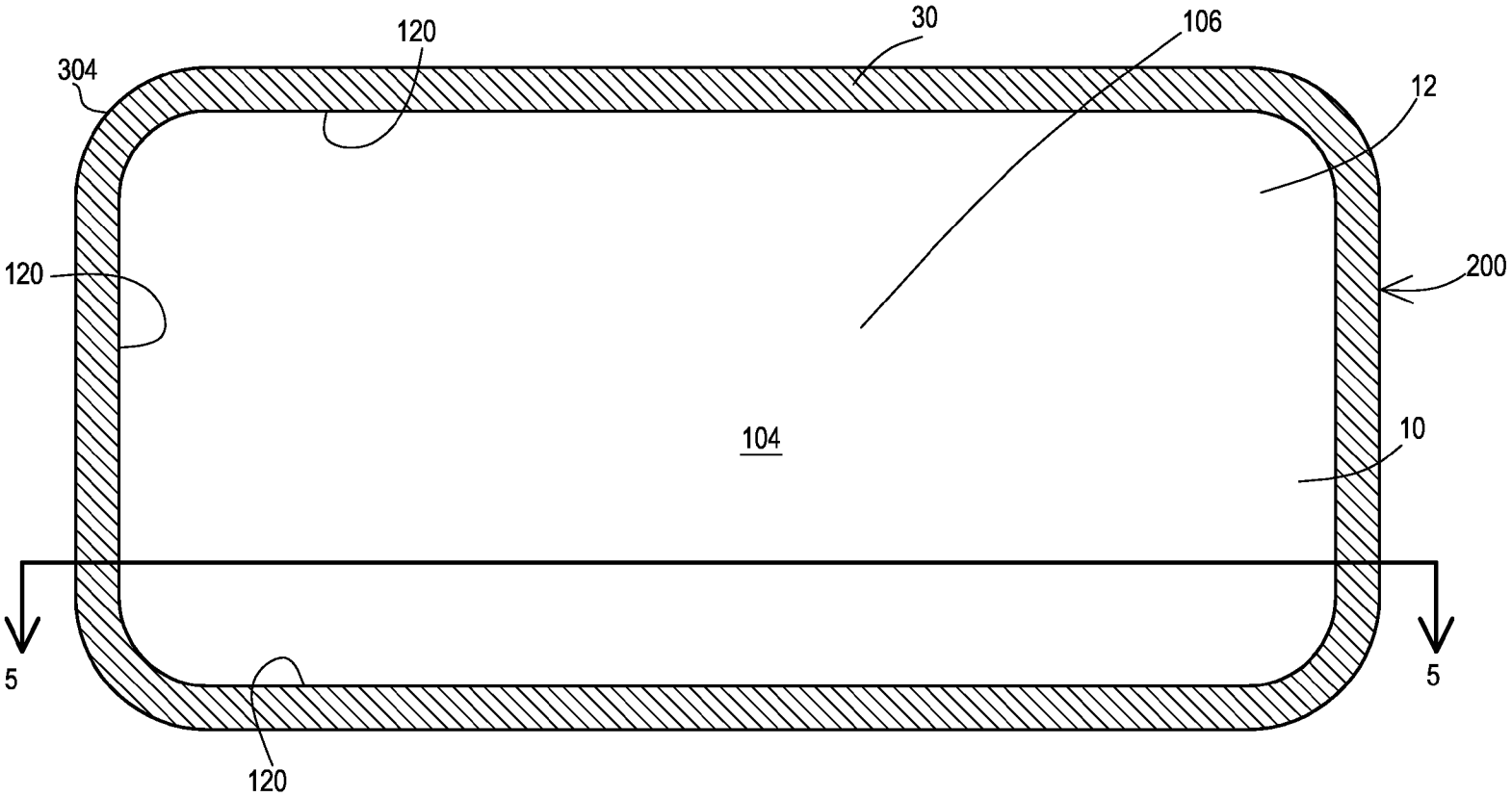
FIG. 4 is a bottom view of another exemplary sound transmissive cover as detailed in another embodiment of the present invention.
Figure 5:
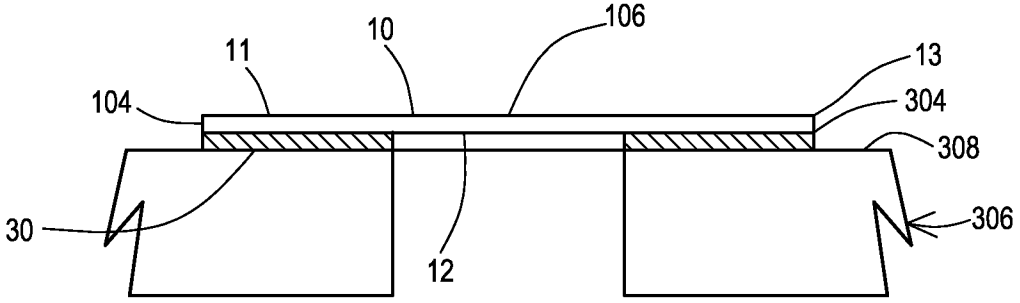
FIG. 5 is a cross-sectional view of the exemplary sound transmissive cover shown in FIG. 4, taken along line 5-5, where the exemplary sound transmissive cover is attached to the surface of a protective enclosure.

FIGS. 4 and 5 illustrate another embodiment of the disclosure where a sound transmissive cover 200 is constructed from a self-tensioning membrane 104 and a double sided adhesive 304. The sound transmissive cover 200 is also shown as it would be attached to the surface 308 of a protective enclosure 306. This embodiment of the disclosure is very similar to that of FIGS. 2 and 3, but the self-tensioning membrane 104 is only bonded on one side and lacks the support of the rigid frame 202. In such a construction, the double-sided adhesive 304 creates a sufficiently strong bond between the membrane 104 and protective enclosure 306 to resist all tension forces created by the self-tensioning membrane 104 and any external forces that may act on the membrane 104. Such an embodiment of the disclosure requires the self-tensioning membrane 104 to either be pre-stretched before adhesion to the surface 308 of a protective enclosure 306, if the membrane 104 is composed of an elastomer, or heated post installation, if the membrane 104 is an oriented film. This requirement is more demanding in installation and therefore the first embodiment of the disclosure is the preferred method.

Figure 6A:
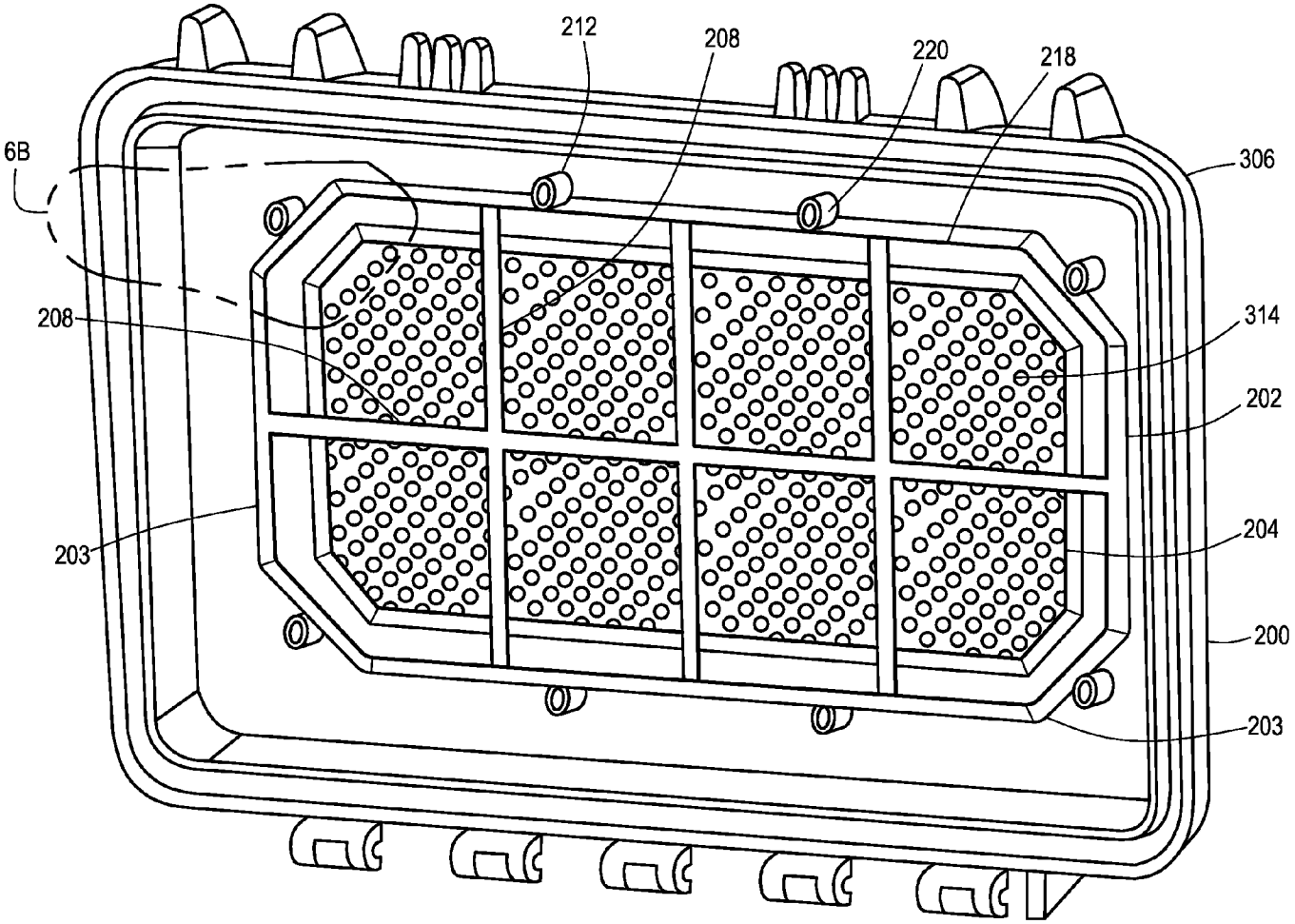
FIG. 6A is a view of another exemplary sound transmission cover in combination with another exemplary protective enclosure.

In other embodiments, the self-tensioning membrane 104 may be mechanically attached to a component (e.g., lid 105) of a protective enclosure 100 with or without the use of adhesive 30. As shown in FIG. 6A, rigid frame 202 comprises (i) an outer frame member 203, and (ii) an acoustic vent opening 204 extending through said rigid frame 202 and surrounded by said outer frame member 203. In this embodiment, rigid frame 202 further comprises intermediate frame members 208, which connect to outer frame member 203, and divide acoustic vent opening 204 into multiple openings (e.g., in the embodiment shown, acoustic vent opening 204 is divided into eight separate openings). Intermediate frame members 208 provide additional support for self-tensioning membrane 104 (i.e., self-tensioning membrane 104 is not shown in FIG. 6A, but would be positioned between rigid frame 202 and protective enclosure 306 and held in place via rigid frame 202). It should be noted that one or more of intermediate frame members 208 may be attached to portions of self-tensioning membrane 104 (i.e., via an adhesive), but typically, each of intermediate frame members 208 are not attached to self-tensioning membrane 104, but provide support as needed if self-tensioning membrane 104 is forcibly moved towards and/or come into contact with intermediate frame members 208.

Figure 6B:
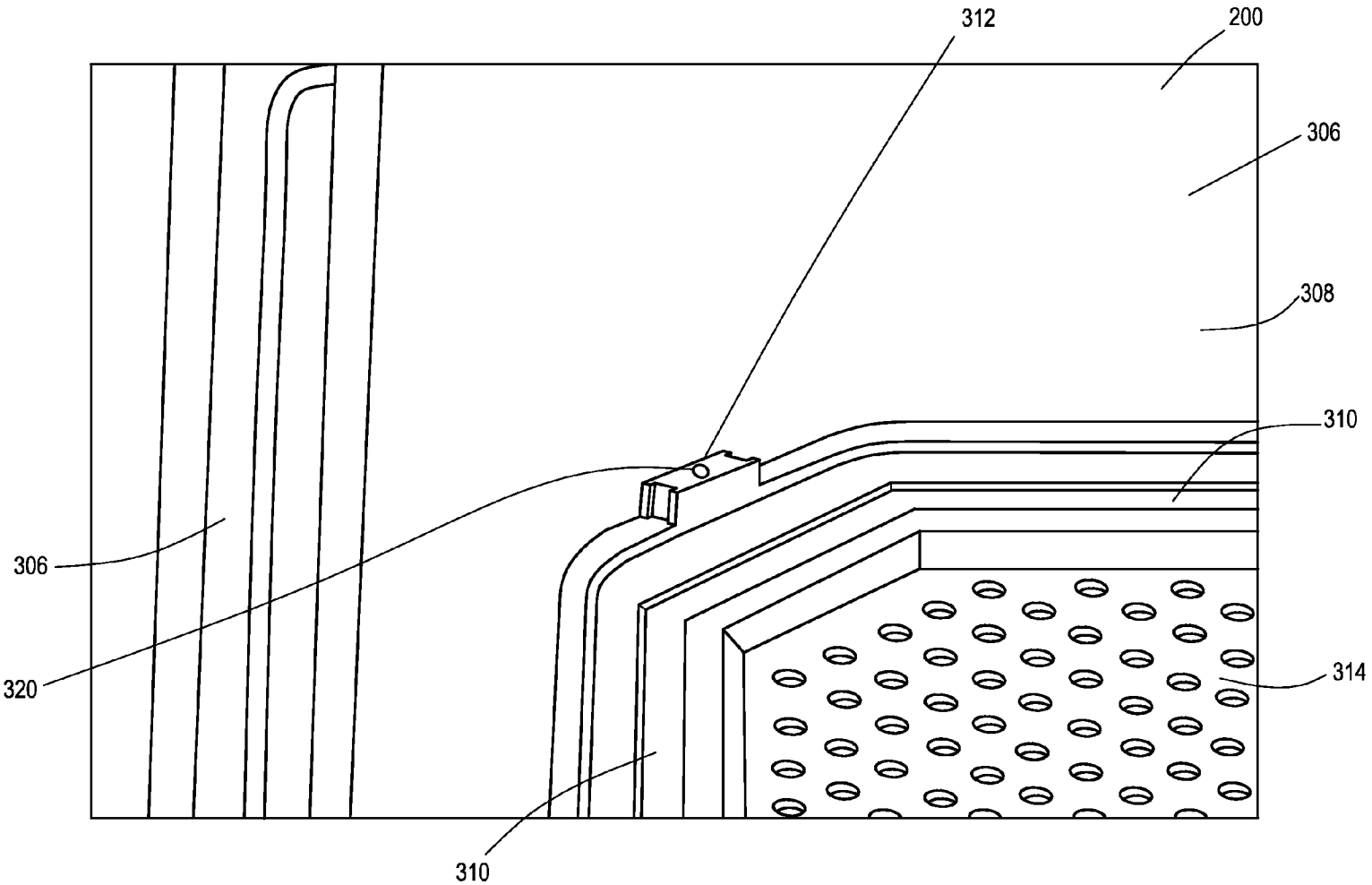
FIG. 6B is a close-up view of the exemplary sound transmission cover shown in FIG. 6A.

FIG. 6B provides a close-up view of the exemplary sound transmission cover 200 shown in FIG. 6A. As shown in FIG. 6B, exemplary sound transmission cover 200 comprises a groove 310 within surface 308 of protective enclosure 306. Groove 310 extends along surface 308 so as to surround an acoustic grid opening 314 within protective enclosure 306.

Figure 7:
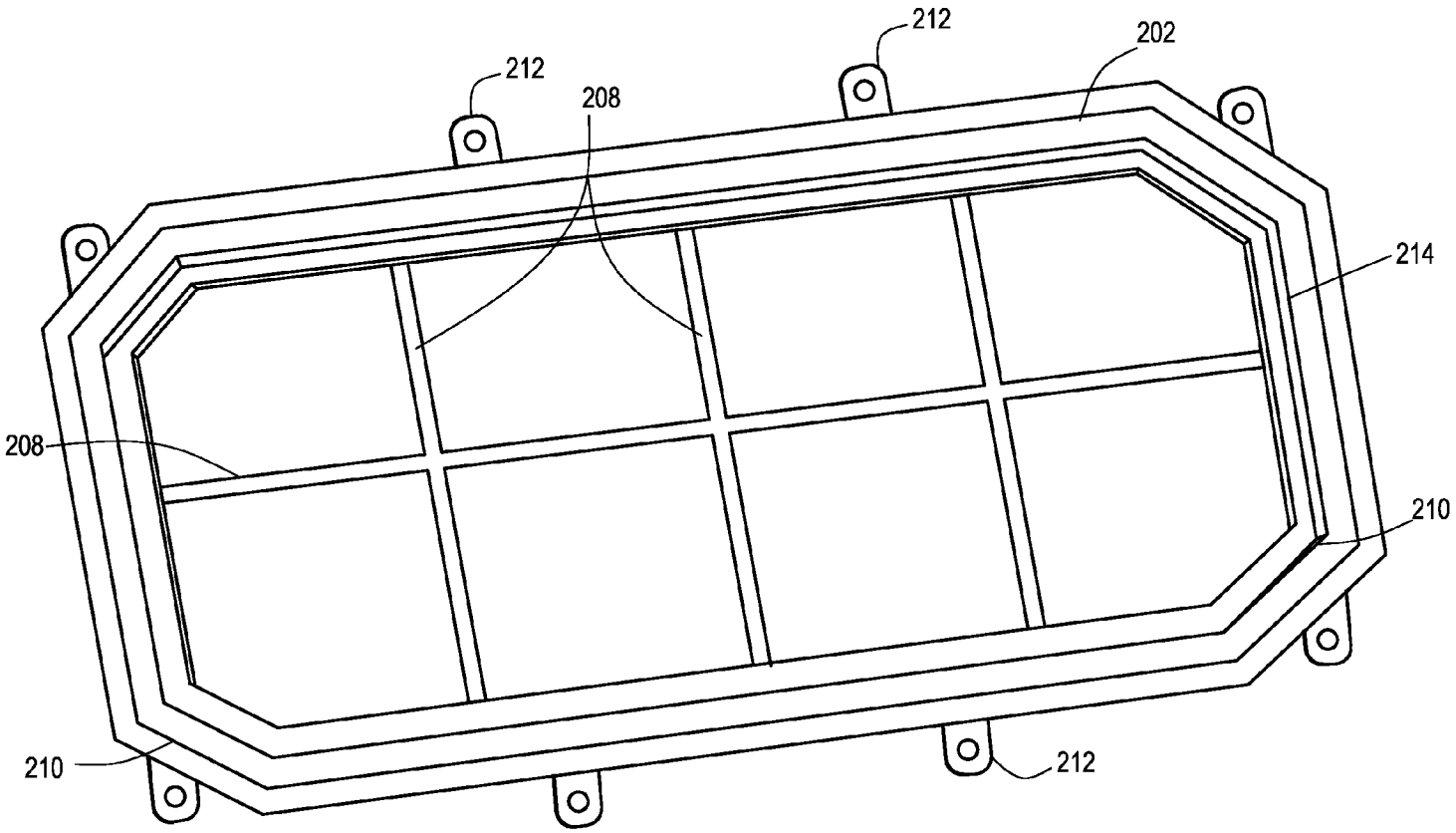
FIG. 7 is a frontal view of the exemplary sound transmission cover shown in FIG. 6.
Figure 8:
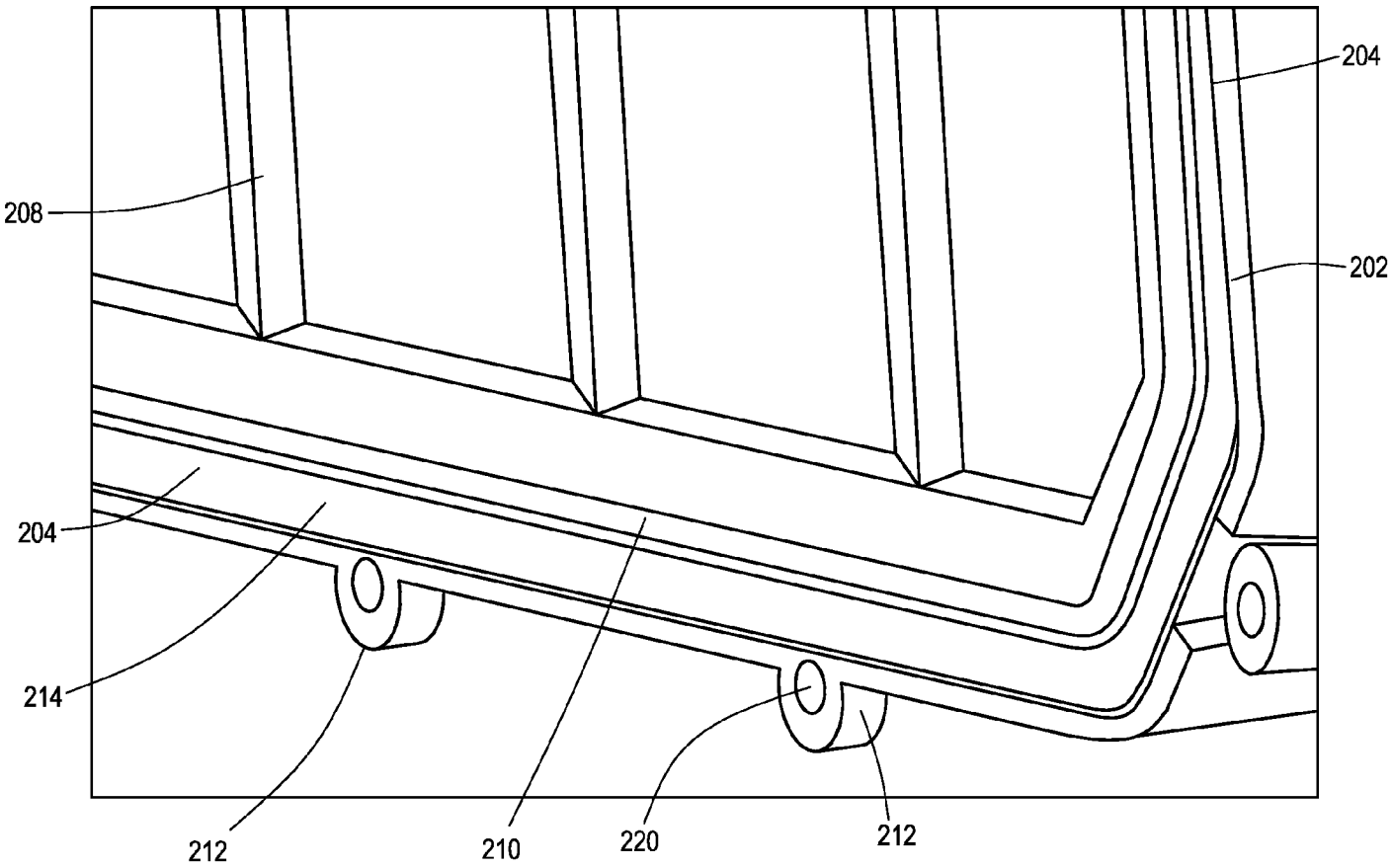
FIG. 8 is a close-up frontal view of the exemplary sound transmission cover shown in FIG. 7.

FIG. 7 provides a frontal view of the exemplary sound transmission cover 200 shown in FIG. 6A. As shown in FIGS. 7-8, a front surface 214 of rigid frame 202 comprises a raised surface portion 210, which has dimensions so as to correspond to and fit within groove 310 within surface 308 of protective enclosure 306 shown in FIG. 6B. Rigid frame 202 further comprises attachment members 212 having hole 220 therein, which may be used to connect rigid frame 202 to surface 308 of protective enclosure 306 shown in FIG. 6B, i.e., via corresponding attachment members 312 having hole 320 therein (e.g., via a screw (not shown)).

Figure 9A:
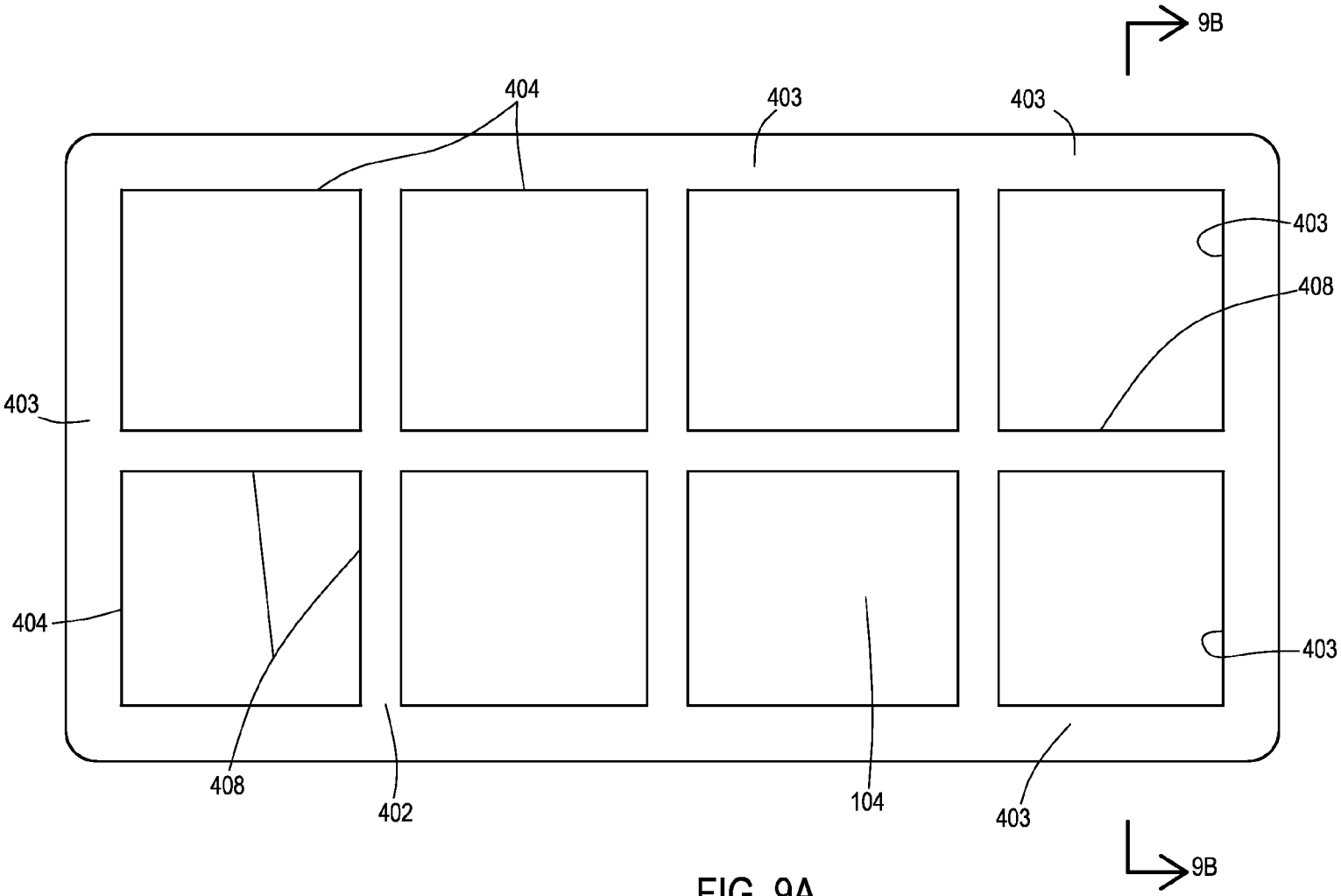
FIG. 9A is a view of another exemplary sound transmission cover.

In yet another embodiment, the self-tensioning membrane 104 may be mechanically and/or adhesively attached to a flexible frame 402 (e.g., a gasket material 402) and/or a protective enclosure 100 with or without the use of adhesive 30 (see, for example, FIG. 3). As shown in FIG. 9A, flexible frame 402 comprises (i) an outer frame member 403, and (ii) one or more acoustic vent openings 404 extending through said frame 402 and surrounded by said outer frame member 403. In this embodiment, frame 402 further comprises intermediate frame members 408, which connect to outer frame member 403, and divide frame 402 into multiple openings (e.g., in the embodiment shown, acoustic vent opening 404 is divided into eight separate openings). Intermediate frame members 408 provide additional support for self-tensioning membrane 104. It should be noted that one or more of intermediate frame members 408 may be attached to portions of self-tensioning membrane 104 (i.e., via an adhesive). Typically, in this embodiment, each of intermediate frame members 408 are attached to self-tensioning membrane 104 (i.e., via an adhesive), so as to provide support for self-tensioning membrane 104.

Figure 9B:
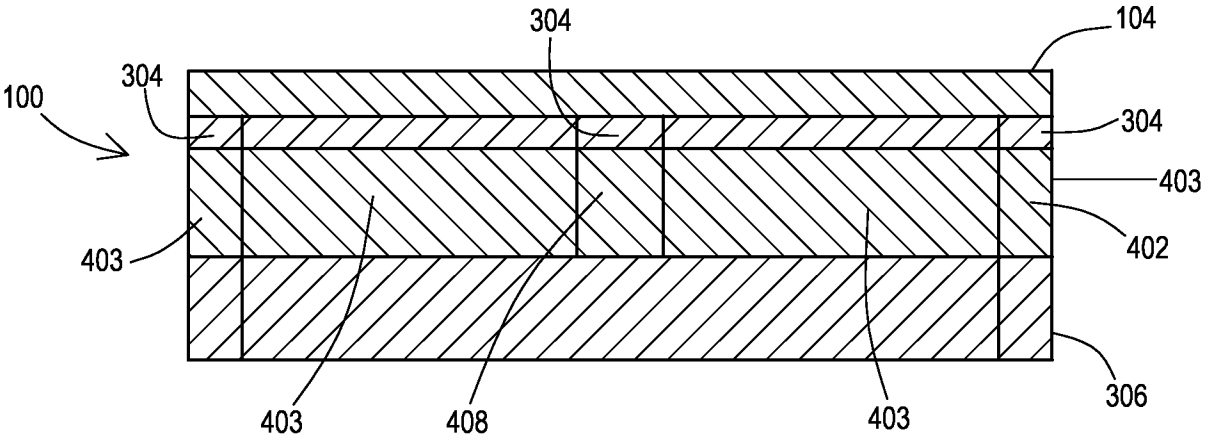
FIG. 9B is a close-up view of area B shown in FIG. 9A when the exemplary sound transmission cover shown in FIG. 9A is attached to an exemplary protective enclosure.

FIG. 9B provides a cross-sectional view of exemplary frame 402 in combination with protective enclosure 306. As shown in FIG. 9B, adhesive 304 may be used to adhesively bond frame 402 to protective enclosure 306 (and bond one or more of intermediate frame members 408 to portions of self-tensioning membrane 104 as discussed above). In other embodiments (not shown), exemplary frame 402 may be mechanically attached (e.g., via a screw (not shown) to sound transmission cover 200 as shown in FIGS. 6A-6B, for example, in place of rigid frame 202) with one or more of intermediate frame members 408 adhesively bonded to portions of self-tensioning membrane 104 as discussed above.

Figure 10:
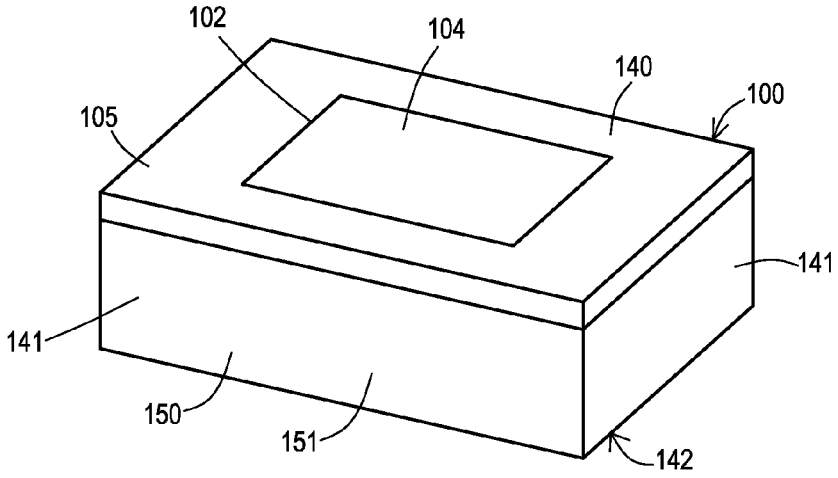
FIG. 10 is a perspective view of another exemplary protective enclosure of the present invention.

FIG. 10 provides a perspective view of another exemplary protective enclosure 100 of the present invention. In this embodiment, exemplary protective enclosure 100 comprises a lid 105 with a single acoustic vent opening 102 therein and a protective membrane 104 extending over the single acoustic vent opening 102. Exemplary protective enclosure 100 further comprises one or more side walls 141 (i.e., depending on the overall shape) extending from an upper surface 140 of lid 105 to a lower surface 142 of exemplary protective enclosure 100.

Figure 11A:
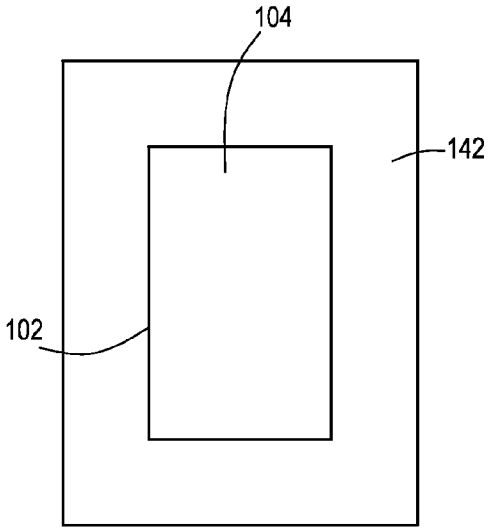
FIGS. 11A-11B depict alternative constructions of outer surfaces of the exemplary protective enclosure shown in FIG. 10.
Figure 11B:
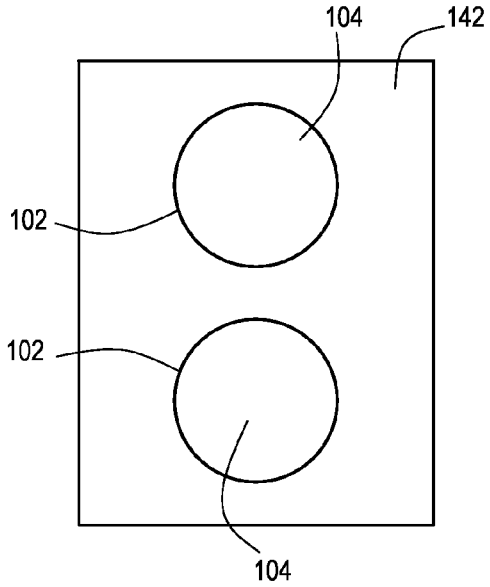

FIGS. 11A-11B depict alternative constructions of lower surface 142 of exemplary protective enclosure 100 shown in FIG. 10. In some embodiments, exemplary protective enclosure 100 shown in FIG. 10 may comprise a single acoustic vent opening 102 therein (i.e., within upper surface 140, but nowhere else). In other embodiments, exemplary protective enclosure 100 may comprise two or more similar or different acoustic vent openings 102 therein. As shown in FIG. 11A, in some embodiments, lower surface 142 of exemplary protective enclosure 100 may further comprise an acoustic vent opening 102 therein, so that protective enclosure 100 comprises a total of two acoustic vent openings 102 therein (i.e., one within upper surface 140 and one within lower surface 142). As shown in FIG. 11B, in other embodiments, lower surface 142 of exemplary protective enclosure 100 may further comprise two separate acoustic vent openings 102 therein, so that protective enclosure 100 comprises a total of three acoustic vent openings 102 therein (i.e., one within upper surface 140 and two within lower surface 142).

Other Embodiments

Protective Membranes

1. A protective membrane 104 comprising: a continuous sheet of self-tensioning polymeric film material 10 having (i) a first major sheet surface 11, (ii) a second major sheet surface 12 opposite said first major sheet surface 11, (iii) an outer sheet edge 13 extending along said first and second major sheet surfaces 11/12, and (iv) an inner unbound sheet region 106 surrounded by said outer sheet edge 13; and a bonding material 30 extending along (i) said first major sheet surface 11 proximate said outer sheet edge 13 thereof, (ii) said second major sheet surface 12 proximate said outer sheet edge 13 thereof, or (iii) both (i) and (ii) so as to completely surround said inner unbound sheet region 106, said continuous sheet of self-tensioning polymeric film material 10 providing a barrier to liquid and particulate material while enabling transmission of sound waves therethrough.

2. The protective membrane 104 of embodiment 1, wherein said continuous sheet of self-tensioning polymeric film material 10 comprises an elastomeric material or a film with shrink capabilities.

3. The protective membrane 104 of embodiment 1 or 2, wherein said continuous sheet of self-tensioning polymeric film material 10 comprises an elastomeric material.

4. The protective membrane 104 of any one of embodiments 1 to 3, wherein said continuous sheet of self-tensioning polymeric film material 10 comprises an elastomeric material capable of being stretched to an area greater than 5% of an original area.

5. The protective membrane 104 of any one of embodiments 1 to 4, wherein said continuous sheet of self-tensioning polymeric film material 10 comprises a thermoplastic polyurethane (TPU).

6. The protective membrane 104 of embodiment 1 or 2, wherein said continuous sheet of self-tensioning polymeric film material 10 comprises a film with shrink capabilities.

7. The protective membrane 104 of any one of embodiments 1 to 2 and 6, wherein said continuous sheet of self-tensioning polymeric film material 10 comprises a film having a free shrinkage of greater than 5% of an original surface area.

8. The protective membrane 104 of any one of embodiments 1 to 2 and 6 to 7, wherein said continuous sheet of self-tensioning polymeric film material 10 comprises a film having a free shrinkage of greater than 20% of an original surface area.

9. The protective membrane 104 of any one of embodiments 1 to 2 and 6 to 8, wherein said continuous sheet of self-tensioning polymeric film material 10 comprises a polyolefin or polyvinyl chloride (PVC).

10. The protective membrane 104 of any one of embodiments 1 to 2 and 6 to 9, wherein said continuous sheet of self-tensioning polymeric film material 10 comprises a polyolefin.

11. The protective membrane 104 of any one of embodiments 1 to 2 and 6 to 10, wherein said continuous sheet of self-tensioning polymeric film material 10 comprises polyethylene.

12. The protective membrane 104 of any one of embodiments 1 to 2 and 6 to 10, wherein said continuous sheet of self-tensioning polymeric film material 10 comprises polypropylene.

13. The protective membrane 104 of any one of embodiments 1 to 2 and 6 to 9, wherein said continuous sheet of self-tensioning polymeric film material 10 comprises polyvinyl chloride (PVC).

14. The protective membrane 104 of any one of embodiments 1 to 13, wherein said continuous sheet of self-tensioning polymeric film material 10 has a film thickness ranging from about 5 microns (μm) to about 100 nm.

15. The protective membrane 104 of any one of embodiments 1 to 14, wherein said continuous sheet of self-tensioning polymeric film material 10 has a film thickness ranging from about 5 nm to about 20 nm.

16. The protective membrane 104 of any one of embodiments 1 to 15, wherein said continuous sheet of self-tensioning polymeric film material 10 has a film basis weight ranging from about 1.0 grams per meter squared ($g/m^2$) to about 35 $g/m^2$.

17. The protective membrane 104 of any one of embodiments 1 to 16, wherein said continuous sheet of self-tensioning polymeric film material 10 has a film basis weight ranging from about 1.0 $g/m^2$ to about 20 $g/m^2$.

18. The protective membrane 104 of any one of embodiments 1 to 17, wherein said bonding material 30 extends along either (i) said first major sheet surface 11 or (ii) said second major sheet surface 12.

19. The protective membrane 104 of any one of embodiments 1 to 17, wherein said bonding material 30 extends along both (i) said first major sheet surface 11, and (ii) said second major sheet surface 12.

20. The protective membrane 104 of any one of embodiments 1 to 19, wherein said bonding material 30 comprises an adhesive.

21. The protective membrane 104 of any one of embodiments 1 to 20, wherein said bonding material 30 comprises a sprayable adhesive 30 (e.g., adhesive 302).

22. The protective membrane 104 of any one of embodiments 1 to 20, wherein said bonding material 30 comprises a double-sided adhesive tape 30 (e.g., adhesive 304).

23. The protective membrane 104 of any one of embodiments 1 to 22, wherein said bonding material 30 comprises (i) a first layer of a sprayable adhesive 30 (e.g., adhesive 302) along one of said first and second major sheet surfaces 11/12, and (ii) a double-sided adhesive tape 30 (e.g., adhesive 304) along the other of said first and second major sheet surfaces 11/12.

24. The protective membrane 104 of any one of embodiments 1 to 23, further comprising a frame 202/402, said frame 202/402 comprising (i) an outer frame member 203/403, and (ii) an acoustic vent opening 204/404 extending through said frame 202/402 and surrounded by said outer frame member 203/403.

25. The protective membrane 104 of any one of embodiments 1 to 24, further comprising a frame 202/402 comprising (i) an outer frame member 203/403, and (ii) an acoustic vent opening 204/404 extending through said frame 202/402 and surrounded by said outer frame member 203/403, said continuous sheet of self-tensioning polymeric film material 10 being bonded to said frame 202/402 such that said inner unbound sheet region 106 of said continuous sheet of self-tensioning polymeric film material 10 is positioned over said acoustic vent opening 204/404.

26. The protective membrane 104 of embodiment 25, wherein said continuous sheet of self-tensioning polymeric film material 10 is either (i) pre-stretched prior to being bonded to said frame 202/402 or (ii) heated after being bonded to said frame 202/402 so as to tension said inner unbound sheet region 106 of said continuous sheet of self-tensioning polymeric film 10.

27. The protective membrane 104 of embodiment 25 or 26, wherein said frame 202/402 comprises a protective enclosure 100, the protective enclosure 100 being sized so as to house a portable loudspeaker device (not shown).

28. The protective membrane 104 of any one of embodiments 25 to 27, wherein said frame 202/402 comprises a lid 105 of a protective enclosure 100, the protective enclosure 100 being sized so as to house a portable loudspeaker device (not shown).

29. The protective membrane 104 of any one of embodiments 25 to 28, said frame 202/402 further comprising one or more intermediate frame members 208/408 extending between portions of said outer frame member 203/403, said one or more intermediate frame members 208/408 dividing said acoustic vent opening 204/404 into two or more separate acoustic vent openings 204/404.

30. The protective membrane 104 of any one of embodiments 25 to 29, wherein said frame 202 comprises a rigid polymeric material.

31. The protective membrane 104 of any one of embodiments 25 to 29, wherein said frame 402 comprises a flexible polymeric material.

32. The protective membrane 104 of any one of embodiments 25 to 29 and 31, wherein said frame 402 comprises a gasket 402.

33. The protective membrane 104 of any one of embodiments 1 to 32, wherein said continuous sheet of self-tensioning polymeric film material 10 has a pore volume of less than about 15% (or any pore volume value between 0 and 15%, in increments of 0.01% (e.g., 0.08%), or any range of pore volume values between 0 and 15%, in increments of 0.01% (e.g., from 0 to 1.15%). Typically, continuous sheet of self-tensioning polymeric film material 10 has a pore volume of less than about 5% (or less than about 4%, or less than about 3%, or less than about 2%, or less than about 1%, or less than about 0.5% or 0%).

34. The protective membrane 104 of any one of embodiments 1 to 33, wherein said continuous sheet of self-tensioning polymeric film material 10 has a pore volume of less than about 10% (or any pore volume value between 0 and 10%, in increments of 0.01% (e.g., 0.08%), or any range of pore volume values between 0 and 10%, in increments of 0.01% (e.g., from 0 to 1.15%).

35. The protective membrane 104 of any one of embodiments 1 to 34, wherein said continuous sheet of self-tensioning polymeric film material 10 has a pore volume of less than about 5% (or any pore volume value between 0 and 5%, in increments of 0.01% (e.g., 0.08%), or any range of pore volume values between 0 and 5%, in increments of 0.01% (e.g., from 0 to 1.15%).

36. The protective membrane 104 of any one of embodiments 1 to 35, wherein said continuous sheet of self-tensioning polymeric film material 10 has an air permeability of at least 60 Gurley-seconds (or any air permeability value greater than 60 Gurley-seconds, in increments of 0.1 Gurley-seconds (e.g., 60.1 or 360.8 Gurley-seconds), or any range of air permeability values greater than 60 Gurley-seconds, in increments of 0.1 Gurley-seconds (e.g., from 60.1 to 3600.0 Gurley-seconds)).

37. The protective membrane 104 of any one of embodiments 1 to 36, wherein said continuous sheet of self-tensioning polymeric film material 10 has an air permeability of at least 120 Gurley-seconds (or any air permeability value greater than 120 Gurley-seconds, in increments of 0.1 Gurley-seconds (e.g., 120.1 or 360.8 Gurley-seconds), or any range of air permeability values greater than 120 Gurley-seconds, in increments of 0.1 Gurley-seconds (e.g., from 120.1 to 3600.0 Gurley-seconds)).

38. The protective membrane 104 of any one of embodiments 1 to 37, wherein said continuous sheet of self-tensioning polymeric film material 10 has an air permeability of at least 3600 Gurley-seconds (or any air permeability value greater than 3600 Gurley-seconds, in increments of 0.1 Gurley-seconds (e.g., 3600.1 Gurley-seconds), or any range of air permeability values greater than 3600 Gurley-seconds, in increments of 0.1 Gurley-seconds (e.g., from 3600.1 to 10000.0 Gurley-seconds)).

39. The protective membrane 104 of any one of embodiments 1 to 38, wherein said continuous sheet of self-tensioning polymeric film material 10 consists of said polymeric film material 10, and said inner unbound sheet region 106 is free from any coating thereon or therein.

Protective Enclosures

40. A protective enclosure 100 sized to house a portable loudspeaker device, said protective enclosure 100 comprising: a protective enclosure case 150 (see, for example, FIG. 10) comprising (i) a rigid protective structure 151, and (ii) an acoustic vent opening 102 extending through said protective enclosure case 150 and surrounded by said rigid protective structure 151; and the protective membrane 104 of any one of embodiments 1 to 39 bonded to said protective enclosure case 150 such that said inner unbound sheet region 106 of said continuous sheet of self-tensioning polymeric film material 10 is positioned over said acoustic vent opening 102. Other protective enclosures 100 of the present invention may comprise a protective enclosure 100 sized to house a portable loudspeaker device, wherein protective enclosure 100 comprising: a protective enclosure case 150 (see, for example, FIG. 10) comprising (i) a rigid protective structure 151, and (ii) an acoustic vent opening 102 extending through said protective enclosure case 150 and surrounded by said rigid protective structure 151; and a continuous sheet of self-tensioning polymeric film material 10 (e.g., as recited in any one of embodiments 1 to 39 with or without a bonding agent 30 attached thereto) bonded to (or otherwise attached to) said protective enclosure case 150 such that said inner unbound sheet region 106 of said continuous sheet of self-tensioning polymeric film material 10 is positioned over said acoustic vent opening 102.

41. The protective enclosure 100 of embodiment 40 in combination with a portable loudspeaker device (not shown).

42. The protective enclosure 100 of embodiment 41, said portable loudspeaker device being positioned within said protective enclosure case 150.

Methods of Making Protective Membranes

43. A method of making the protective membrane 104 of any one of embodiments 1 to 39, said method comprising: providing the continuous sheet of self-tensioning polymeric film material 10; and applying the bonding material 30 onto the continuous sheet of self-tensioning polymeric film material 10.

44. The method of embodiment 43, wherein said applying step comprises applying the bonding material 30 along either (i) the first major sheet surface 11 or (ii) the second major sheet surface 12.

45. The method of embodiment 43, wherein said applying step comprises applying the bonding material 30 along both (i) the first major sheet surface 11, and (ii) the second major sheet surface 12.

46. The method of any one of embodiments 43 to 45, wherein said method further comprises: bonding the continuous sheet of self-tensioning polymeric film material 10 to a frame 202/402, the frame 202/402 comprising (i) an outer frame member 203/403, and (ii) an acoustic vent opening 204/404 extending through the rigid frame 202/402 and surrounded by the outer frame member 203/403, the continuous sheet of self-tensioning polymeric film material 10 being bonded to the frame 202/402 such that the inner unbound sheet region 106 of the continuous sheet of self-tensioning polymeric film material 10 is positioned over the acoustic vent opening 204/404.

Methods of Making Protective Enclosures

47. A method of making the protective enclosure 100 of embodiment 40, said method comprising: providing the continuous sheet of self-tensioning polymeric film material 10; applying the bonding material 30 onto the continuous sheet of self-tensioning polymeric film material 10; and bonding the continuous sheet of self-tensioning polymeric film material 10 to the rigid protective structure 151 such that the inner unbound sheet region 106 of the continuous sheet of self-tensioning polymeric film material 10 is positioned over the acoustic vent opening 204/404.

48. The method of making the protective enclosure 100 of embodiment 47, wherein said bonding step comprises (1) bonding the continuous sheet of self-tensioning polymeric film material 10 to a frame 202/402, the frame 202/402 comprising (i) an outer frame member 203/403, and (ii) an acoustic vent opening 204/404 extending through the frame 202/402 and surrounded by the outer frame member 203/403, the continuous sheet of self-tensioning polymeric film material 10 being bonded to the frame 202/402 such that the inner unbound sheet region 106 of the continuous sheet of self-tensioning polymeric film material 10 is positioned over the acoustic vent opening 204/404 in the frame 202/402, and (2) bonding the continuous sheet of self-tensioning polymeric film material 10/frame 202/402 to the rigid protective structure 151.

49. The method of any one of embodiments 46 to 48, said method further comprising: pre-stretching the continuous sheet of self-tensioning polymeric film material 10 prior to said bonding step.

50. The method of any one of embodiments 46 to 48, said method further comprising: heating the continuous sheet of self-tensioning polymeric film 10 after said bonding step so as to tension the inner unbound sheet region 106 of the continuous sheet of self-tensioning polymeric film 10.

51. The method of any one of embodiments 47 to 50, said method further comprising: positioning a portable loudspeaker device (not shown) within the protective enclosure case 150.

Methods of Using Protective Membranes

52. A method of transmitting sound, said method comprising: transmitting sound through the first and second major sheet surfaces 11/12 of (i) the protective membrane 104 of any one of embodiments 1 to 39 or (ii) the protective membrane 104 of the protective enclosure 100 of any one of embodiments 40 to 42.

53. The method of embodiment 52, said method further comprising: positioning a portable loudspeaker device (not shown) proximate one of the first and second major sheet surfaces 11/12.

54. The method of embodiment 52 or 53, said transmitting step comprises transmitting sound from within a rigid protective structure 151 of a protective enclosure 100 such that sound waves pass through the inner unbound sheet region 106 of the continuous sheet of self-tensioning polymeric film material 10 to an exterior of the rigid protective structure 151.

55. A method of water-proofing a portable loudspeaker device protective enclosure 100, said method comprising: positioning the protective membrane 104 of any one of embodiments 1 to 39 over an acoustic vent opening 102 of the portable loudspeaker device protective enclosure 100.

It should be understood that although the above-described protective membranes 104, protective enclosures 100, and methods are described as "comprising" one or more components or steps, the above-described protective membranes 104, protective enclosures 100, and methods may "comprise," "consists of," or "consist essentially of any of" the above-described components or steps of the protective membranes 104, protective enclosures 100, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a protective membrane 104, a protective enclosure 100, and/or method that "comprises" a list of elements (e.g., components or steps) is not necessarily limited to only those elements (or components or steps), but may include other elements (or components or steps) not expressly listed or inherent to the protective membrane 104, protective enclosure 100, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a protective membrane 104, a protective enclosure 100, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described protective membranes 104, protective enclosures 100, and/or methods may comprise, consist essentially of, or consist of any of the herein-described components and features, as shown in the figures with or without any feature(s) not shown in the figures. In other words, in some embodiments, the protective membranes 104, protective enclosures 100, and/or methods of the present invention do not have any additional features other than those shown in the figures, and such additional features, not shown in the figures, are specifically excluded from the protective membranes 104, the protective enclosures 100, and/or methods. In other embodiments, the protective membranes 104, the protective enclosures 100, and/or methods of the present invention do have one or more additional features that are not shown in the figures.

The present invention is further illustrated by the following examples, which are not to be construed in any way as imposing limitations upon the scope thereof On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Protective membranes and protective enclosures, similar to exemplary protective membranes 104 and protective enclosures 100 shown in FIGS. 1-11B, were prepared.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A protective membrane comprising:

a continuous sheet of self-tensioning polymeric film material having (i) a first major sheet surface, (ii) a second major sheet surface opposite said first major sheet surface, (iii) an outer sheet edge extending along said first and second major sheet surfaces, and (iv) an inner unbound sheet region surrounded by said outer sheet edge; and a bonding material extending along (i) said first major sheet surface proximate said outer sheet edge thereof, (ii) said second major sheet surface proximate said outer sheet edge thereof, or (iii) both (i) and (ii) so as to completely surround said inner unbound sheet region, said continuous sheet of self-tensioning polymeric film material providing a barrier to liquid and particulate material while enabling transmission of sound waves therethrough.

2. The protective membrane of claim 1, wherein said continuous sheet of self-tensioning polymeric film material comprises an elastomeric material or a film with shrink capabilities.

3. The protective membrane of claim 1, wherein said continuous sheet of self-tensioning polymeric film material comprises a polyolefin, a thermoplastic polyurethane (TPU) or polyvinyl chloride (PVC).

4. The protective membrane of claim 1, wherein said continuous sheet of self-tensioning polymeric film material has a film thickness ranging from about 5 microns (μm) to about 100 μm.

5. The protective membrane of claim 1, wherein said continuous sheet of self-tensioning polymeric film material has a film basis weight ranging from about 1.0 grams per meter squared ($g/m^2$) to about 35 $g/m^2$.

6. The protective membrane of claim 1, wherein said bonding material extends along either (i) said first major sheet surface or (ii) said second major sheet surface.

7. The protective membrane of claim 1, wherein said bonding material extends along both (i) said first major sheet surface, and (ii) said second major sheet surface.

8. The protective membrane of claim 1, wherein said bonding material comprises an adhesive.

9. The protective membrane of claim 1, further comprising a frame comprising (i) an outer frame member, and (ii) an acoustic vent opening extending through said frame and surrounded by said outer frame member, said continuous sheet of self-tensioning polymeric film material being bonded to said frame such that said inner unbound sheet region of said continuous sheet of self-tensioning polymeric film material is positioned over said acoustic vent opening.

10. The protective membrane of claim 9, wherein said frame comprises a protective enclosure, the protective enclosure being sized so as to house a portable loudspeaker device.

11. The protective membrane of claim 9, wherein said frame comprises a lid of a protective enclosure, the protective enclosure being sized so as to house a portable loudspeaker device.

12. The protective membrane of claim 9, said frame further comprising one or more intermediate frame members extending between portions of said outer frame member, said one or more intermediate frame members dividing said acoustic vent opening into two or more separate acoustic vent openings.

13. The protective membrane of claim 1, wherein said continuous sheet of self-tensioning polymeric film material has a pore volume of less than about 10%.

14. The protective membrane of claim 1, wherein said continuous sheet of self-tensioning polymeric film material has an air permeability of at least 60 Gurley-seconds.

15. The protective membrane of claim 1, wherein said continuous sheet of self-tensioning polymeric film material consists of said polymeric film material, and said inner unbound sheet region is free from any coating thereon or therein.

16. A protective enclosure sized to house a portable loudspeaker device, said protective enclosure comprising:

a protective enclosure case comprising (i) a rigid protective structure, and (ii) an acoustic vent opening extending through said protective enclosure case and surrounded by said rigid protective structure; and the protective membrane of claim 1 bonded to said protective enclosure case such that said inner unbound sheet region of said continuous sheet of self-tensioning polymeric film material is positioned over said acoustic vent opening.

17. The protective enclosure of claim 16 in combination with a portable loudspeaker device, said portable loudspeaker device being positioned within said protective enclosure case.

18. A method of transmitting sound, said method comprising:

transmitting sound through the first and second major sheet surfaces of (i) the protective membrane of claim 1.

19. The method of claim 18, said transmitting step comprises transmitting sound from within a rigid protective structure of a protective enclosure such that sound waves pass through the inner unbound sheet region of the continuous sheet of self-tensioning polymeric film material to an exterior of the rigid protective structure.

20. A method of water-proofing a portable loudspeaker device protective enclosure, said method comprising:

positioning the protective membrane of claim 1 over an acoustic vent opening of the portable loudspeaker device protective enclosure.

* * * * *